US008297002B2

(12) United States Patent
Fernández Fernández

(10) Patent No.: US 8,297,002 B2
(45) Date of Patent: Oct. 30, 2012

(54) CONSTRUCTIVE SYSTEM

(75) Inventor: José Javier Fernández Fernández, Ortuella (ES)

(73) Assignee: Habidite, S.A., Ortuella (ES)

( * ) Notice: Subject to any disclaimer, the term of this patent is extended or adjusted under 35 U.S.C. 154(b) by 360 days.

(21) Appl. No.: 12/516,923

(22) PCT Filed: Mar. 1, 2007

(86) PCT No.: PCT/ES2007/000112

§ 371 (c)(1),
(2), (4) Date: Feb. 5, 2010

(87) PCT Pub. No.: WO2008/065216

PCT Pub. Date: Jun. 5, 2008

(65) Prior Publication Data

US 2010/0132271 A1 Jun. 3, 2010

(30) Foreign Application Priority Data

Dec. 1, 2006 (ES) ..... 200603078

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |

(52) U.S. Cl. ..... 52/79.9; 52/79.1; 52/79.13; 52/79.14; 52/79.5

(58) Field of Classification Search ..... 52/79.1, 52/79.9, 236.3, 79.13, 79.14, 79.5, 167.1, 52/424, 582.1; 220/1.5, 4.33, 4.26
See application file for complete search history.

(56) References Cited

U.S. PATENT DOCUMENTS

| | | | | |
|---|---|---|---|---|
| 3,073,466 | A * | 1/1963 | Greer et al. | 414/498 |
| 3,907,147 | A * | 9/1975 | Goobeck | 220/1.5 |
| 4,059,931 | A | 11/1977 | Mongan | |
| 4,599,829 | A * | 7/1986 | DiMartino, Sr. | 52/79.7 |
| 4,644,708 | A | 2/1987 | Baudot et al. | |
| 4,694,621 | A * | 9/1987 | Locke | 52/79.13 |
| 4,813,542 | A * | 3/1989 | Thompson et al. | 206/504 |
| 5,193,325 | A * | 3/1993 | Allison | 52/745.02 |
| 5,678,715 | A * | 10/1997 | Sjostedt et al. | 220/1.5 |
| 5,706,614 | A * | 1/1998 | Wiley et al. | 52/79.1 |
| 5,735,639 | A * | 4/1998 | Payne et al. | 405/129.57 |
| 5,755,063 | A | 5/1998 | Ohnishi et al. | |
| 6,871,453 | B2 * | 3/2005 | Locke | 52/79.13 |
| 2004/0045223 | A1 | 3/2004 | Deskin | |

(Continued)

FOREIGN PATENT DOCUMENTS

| | | |
|---|---|---|
| EP | 0 513 949 | 11/1992 |
| EP | 1 700 964 | 9/2006 |
| JP | 3-241129 | 10/1991 |
| WO | WO 90/10127 | 9/1990 |

*Primary Examiner* — Mark Wendell
(74) *Attorney, Agent, or Firm* — Merchant & Gould P.C.

(57) ABSTRACT

The invention relates to a dwelling module, a roof module, a balcony module, a facade module, a building and a lifting tool for a modular construction system used to form a building from the aforementioned modules. The dwelling module (3) includes a floor (31), a roof (34T) and pillars between the floor (31) and the roof (34T). The pillars contain an embedded multi-purpose part (32) which is used to stack one module on top of another. The roof module is positioned on top of the building, while the balcony module (359) and the facade module (310) can be positioned peripherally to the building. The lifting tool is used to transport and install the dwelling module (3) at the desired site in order to complete a building.

46 Claims, 10 Drawing Sheets

U.S. PATENT DOCUMENTS

2004/0083671 A1* 5/2004 Johnson et al. ..... 52/511
2006/0059792 A1 3/2006 Tiramani
2007/0271857 A1* 11/2007 Heather et al. ..... 52/79.9
2011/0011011 A1* 1/2011 Bjerre ..... 52/79.9
2011/0056147 A1* 3/2011 Beaudet ..... 52/79.9
2011/0232543 A1* 9/2011 Burroughs et al. ..... 109/79

* cited by examiner

CONSTRUCTIVE SYSTEM

This application is a National Stage Application of PCT/ES2007/000112, filed 1 Mar. 2007, which claims benefit of Serial No. P200603078, filed 1 Dec. 2006 in Spain and which applications are incorporated herein by reference. To the extent appropriate, a claim of priority is made to each of the above disclosed applications.

FIELD OF THE INVENTION

The invention is comprised in the field of modular construction systems, contemplating dwelling modules, roof modules, balcony modules and façade modules forming a building from said modules.

BACKGROUND OF THE INVENTION

Document EP1700964 shows a modular building system and a method for level assembling of prefabricated building modules. The modular system consists of high-resistance reinforced concrete module, to be stacked vertically and placed side-by-side in the construction of preferably residential buildings. Each module forms a monolithic structure or consists of a steel frame and panels with walls, roof and floor. These modules include positioning devices for stacking purposes; side connection elements between the modules and/or horizontal and vertical tightening bands. The modules are leveled by using leveling sheets and/or non-retraction mortar and/or a method with jacks and tubular sections filled with non-retraction mortar until it sets and the jacks are removed. Each building module includes all the accessories and finishing elements of a home, such as façades, windows, utilities, furniture and interior equipment.

DESCRIPTION OF THE INVENTION

The invention relates to dwelling modules, roof modules and buildings constructed from said modules. With respect to traditional productive systems, its offers innumerable advantages as regards the quality of the buildings, the reduction of the environmental impact, the prevention of occupational hazards and the drastic reduction of execution times.

One of the great problems occurring in construction is the actual constructive system.

It could currently be stated that said process comprises a succession of more or less artisanal works which are continuously affected by external factors which, on a number of occasions, cause according to the case, a worse finishing, delays, higher cost and greater risks, among others.

Therefore, a factory production system not only allows reducing the execution periods, the risks and preventing contingencies in the costs, but it also enables an execution and finishing control similar to that of any mass production factory.

All this is achieved for several reasons:

The tasks are perfectly planned, therefore there are no contingencies which can affect production.

As it is a closed place, meteorological factors, which would mean a loss of time and quality and cost and risk increase, have no effect.

All the raw material incorporated into the module previously pass through a pre-assembly process where they are prepared for their placement; this favors the work in optimal conditions both in the pre-assembly area and in the modules, and the cuttings and excesses of material are likewise considerably reduced.

In the same way, as they are cyclic works in a controlled medium, occupational accidents are considerably reduced.

In the manufacturing process, starting from raw material, a completely finished fraction of a building, a module, is obtained which will subsequently be attached to other modules to form said building.

These building fractions have the great advantage of having incorporated therein: partitions, façades, paint, internal and external carpentry, closets, kitchen with household appliances, sanitary fittings, bathroom accessories, and especially the installations having prepared special connection systems located in holes for attaching them with other contiguous modules.

This way of producing dwellings represents advantages similar to those of the mass production of any other product, such as automobiles, allowing not only an important reduction of execution times but also a clear cost reduction, a spectacular increase of occupational safety, an important improvement in aspects relating to environmental impact and favors the development of a strong industrial fabric through not only the actual plant, but also through the auxiliary industry, acting as the tractor unit of economy in its implementation area.

The constructive system contemplates the manufacture of the different elements forming a housing complex in a controlled and stable medium, such as an industrial plant by means of a mass production process. Once such elements are completed, said elements are transported to the point of destination and there the building is definitively assembled.

In parallel, a logical response adapted to the social and cultural context by means of high urban, typological and aesthetic flexibility. The interest lies not only in a quick construction with a high degree of quality, but also that the solution can be adapted to the continuous changes required by variations in the trends and preferences in the construction field. The building is thus incorporated to the supply and demand market.

The developed buildings are the result of combining industrialized modules, the weight and measurement of which allow the transport through conventional means. The modules form habitable rooms, containing all the necessary installations and finishings for their use.

This constructive system allows developing any building, independently of the use which will be housed therein, being able to adjust the internal configuration of the modules for the necessary requirements.

The size, shape and dimension of the building typologies is unlimited, being exclusively linked to the typical rules of a modular combination (the dimensions obtained are multiples of the smallest dimension of the module). The functional rationality integrated in the design and conformation of the different modules, together with the various combinations thereof, gives rise to multiple distributions.

In the development of residential buildings, the modular combination allows obtaining a number of varied distributions, having as an aim that of achieving the best possible spatial quality and habitability in each case.

There are a large number of possibilities in the configuration, being able to include educational buildings, healthcare centers, hotels, homes, prisons.

As an example, with regard to dwellings, apartments with a single room, single-family buildings and dwellings with as many bedrooms as desired can be generated, also being able to choose different kitchen (American or independent) configurations and to include or choose from different supplementary rooms (lavatory, dressing room, store room, work area, and others), through the attachment of as many modules as necessary.

All the building configurations arise from simple and comfortable distributions facilitating their daily operation and use, solving from the actual design the location of closets, storing solutions and optimal location of household appliances.

The habitable modules are complemented with others intended for balconies, elevator shafts, staircases, hallways or roofs, to form the building as a whole, already having all the installations integrated from its manufacture, such as sanitary, electric, domotic, heating, air conditioning installations and others.

Thus, what could be called the end product is the building completely constructed from level zero, completed and finished to be delivered to its future tenants in a perfect use and habitability state.

To that end, different modules constructed completely in the factory, such that after the manufacturing process they are transported to the place of destination and are finally assembled with suitable auxiliary means.

The structure of the building from level zero (garages, ground floors, establishments, foundation, and others) is carried out in situ, on site. This is carried out with the usual methods in construction.

The complete units can be of mainly three types: dwelling modules, balcony modules and roof modules. The first two modules correspond to the compartments intended for dwelling, whereas the third group includes plates serving as an upper crown of the building.

Furthermore, there are other elements involved in the assembly, such as level zero elements of the prefabricated structure (beams and pillars) on which the first floor is supported. The types of modules and other components of the invention are described below:

Dwelling Modules

The dwelling modules have a rectangular parallelepiped geometry, i.e., rectangular prisms with large dimensions, modulated so that very diverse typological combinations can be configured with them.

The main supporting structure is based on a horizontal floor, four vertical pillars at the corners thereof, four perimetrical upper beams and a slab supported on the latter as a roof.

Said lower floor is formed by a horizontal slab supported on three longitudinal (pre-stressed or post-stressed) beams and two transverse beams, which is what mainly supports the loads inside the dwelling. Together with this floor, the remaining beams and pillars form the reinforcement of the module, which is turn braced by the perimetrical and internal partitions configuring the distributions of the dwelling. Said walls work as large screens for transmitting horizontal loads and for providing the assembly with more rigidity and firmness.

Each pillar has embedded therein a Multi-purpose Pillar Part (MPP), i.e., 4 MPP for each module. This part is detailed below.

Finally, the roof is an also prefabricated slab, but which is executed separately and added afterwards in order to not interfere in the indoor preparation and finishing phases. This slab is supported in the recess made to the upper perimetrical beams. There are three options for maintaining tightness:

Placing a profile of a polymeric material which is anchored to other metal profiles embedded in the concrete.

Sealing the entire attachment surface with a silicone bead.

Carrying out this sealing with mortar.

There are basically three types of dwelling modules:

1. Corner modules
2. Façade modules
3. Internal modules

Corner modules are those in which two façade modules meet at 90°; the second modules only have one façade wall, the remaining faces of the parallelepiped being located inside the building; and the third modules are those which do not contain any façade face.

The staircases, corridors, elevators, doorways and other commonly used elements inside a building of dwellings are also grouped into dwelling modules, i.e., the building is made entirely by means of modules.

Balcony Modules

Balcony modules are self-supporting modules with smaller dimensions than dwelling modules, and are different from the latter in that, instead of being supported on one another, they project, anchored to the sides of the adjoining dwelling modules.

Balcony modules are supported on screws which are embedded in the lower transverse beams of the dwelling modules (corners and center), while at the same time they are fixed in the multi-purpose part at the upper part.

Despite the fact that their structure has features similar to those of dwelling modules, they do no have to be closed and can even be without a cover roof. The balcony module is also manufactured entirely in the factory and it is anchored to the dwelling module before being transported to the construction site.

Roof Modules

Roof modules serve as a crown for the building for collecting rainwater, they can basically be of three types:

Roof plates.

Roof plates with barrier.

Corner barriers.

Roof plates are elements the base dimensions of which coincide exactly with those of dwelling modules; in fact, they are supported on the last inhabitable floor of the building in the same manner as if they were a dwelling module, i.e., by means of the MPP which are fitted in the upper conical gaps of the MPP of the last floor of the dwelling module.

Their structure consists of a lower slab supported by two longitudinal beams and three transverse beams, which generate a grid forming the so-called basins. It has the MPPs embedded at the corners.

In each plate there are, therefore, two basins separated by the central transverse beam, which is traversed by a weep hole allowing the flow of liquid from one basin to the other one.

They correspond to those parts located in the internal area of the building, i.e., the roof plates are placed on internal modules.

The roof plates with barrier are identical to roof plates, but with the exception that are located on façade or corner modules, i.e., in the contour of the building. Their largest dimension is therefore increased to adjoin an L-shaped projecting ledge, i.e., a horizontal area for the passage of people plus a vertical barrier. Thus, in addition to covering the area of the balcony modules at the top, the rest of the building is provided with an eave projecting from the strict floor of the building. In the area of the end opposite to that of the barrier, a small box as a hole for connecting the plate with the contiguous plate.

Finally, corner barriers are the roof parts located in the angles of the buildings are placed against the long side of the roof plates with barrier to close the peripheral ledge at the base. These barriers, as they project, must be fixed to the remaining plates with conventional mechanical anchorings.

As has been mentioned, the roof modules also incorporate the multi-purpose pillar part like the dwelling modules. The lifting and connections of the modules are thus ensured.

The operation of the roof is such that it allows collecting all the rainwater falling on the rooftop and channeling it to the central roof plates, consisting of orifices through which they are led to rainwater downpipes.

The plates house independent waterproof tubs to collect the water without it coming into contact with the surface of said plates; the waterproof basins are connected through the weep holes.

By means of a rainwater filtering system (such as for example with roofs with gardens and geotextile roofs), the water is separated into two levels: the upper level, where it is stored to thermally insulate the building (or to hydrate the plants layer in the event that it exists), and the lower level, which is where the water is drained to the orifices connecting with the downpipes.

In each plate, the basins are connected to one another by means of weep holes, but between adjacent plates a connecting tube which is especially designed to hermetically lead the water without leaks or losses is necessary.

For that purpose, there is a combined threading, tonguing and grooving and encasing system ensuring that the connection of one plate to the other is perfectly tight. To that end, there is a connecting tube which is housed inside the box and which is connected to the adjacent plate once the entire roof is assembled.

The threading is between the connecting tube and the destination plate; the tonguing and grooving is with the reinforcement connection tube of that plate; and the embedment is of the connecting tube in the wall of the box of the origin plate. Said box is provided with its own lid in order to make a hole in it in the event that it is necessary.

FaÇade

To achieve a complete thermal, sound insulation and a waterproofing of the façade modules and corner modules, a completely independent and versatile reinforced external concrete panel with an external coating capable of adapting any type of material is placed on them.

The panels are rectangular and are manufactured in the factory, and coupled to the dwelling modules in the factory. They are anchored in the hooks of the MPP at the upper part to prevent the overturn, whereas they are supported at the ends and center of the lower longitudinal beams by means of screws at the lower part, like the balcony modules.

As can be observed, it is a ventilated façade; it has the insulation placed against the concrete of the module, leaving an air chamber between said insulator and the façade panel.

To cover the attachments of said panels, vertical and horizontal imposts could be used as trims. The horizontal imposts are incorporated in the façade panels, i.e., they are part of the panel, whereas the vertical imposts are introduced by fitting between the profiles of two contiguous façades.

This profile also serves to house, in the event that there are no vertical imposts, a vertical band formed by waterproofing and insulating material to close the joint between two contiguous façade panels.

The advantages of this façade system are:

Disappearance of damp patches

Greater thermal and sound insulation

Greater durability

Completely independent and versatile external finishing

Multi-Purpose Pillar Part

The key part allowing the assembly to be carried out correctly is Multi-purpose Pillar Part, MPP.

The MPP has 3 parts:

1. upper part: At the upper part there is located the cone serving as a support for the MPP of the upper module, the securing receptacles (for the side screwed attachments and the anchoring of façades and balconies) and the leveling screw which also serves as a hook of the lifting tool. The lower part of the cone, in the metal flat, has 3 orifices; that of the leveling screw (and rod), another circular orifice through which the mortar attaching the upper and lower cones is poured and another square orifice (air outlet) where the mortar rises and closes the circuit. At the upper part there are also corrugated bars welded to the metal flat serving as an anchoring for fixing the MPP to the concrete of the pillar.
2. central part: It is the intercommunicator of the upper cone and of the lower cone. It is formed by 2 circular tubes and a central tubular square bar steel.

The central contains the leveling rod and the 2 side tubes are useful for the mortar to communicate the 2 cones. This part of the MPP is divided into 2 parts, due to the fact that the concreting process is carried out in two phases: first the floor and then the elevations (pillars, upper beams and walls).

Therefore, the lower section of said sleeve ends with a wider tube so that the second sleeve section is coupled therein. In this second section, fixing stops are fixed so that there is a clearance between the two sections, which allows the rod to move upwards or downwards. The latter is turn has other stops preventing the rod from falling and coming out of the pillar while lifting the module. A similar joining is carried out with the tube for filling with mortar and the air discharge tube, which have a coupling nozzle to ensure the continuity thereof.

3. lower part, or lower cone, which is the part which is coupled to the upper cone of the MPP of the lower module. It is perforated by 3 orifices, which is where the mortar conducting tube and the metal sleeve where the central rod is housed end.

As has been indicated, the Multi-purpose Pillar part, MPP, is inserted in each of the pillars, which part basically has six functions:

1—Lifting:

The upper screw of the MPP is used as a hook of a special lifting tool which will lift the module for its transport.

2—Approximation:

The fact that the lower and upper ends of the MPP are conical is essential to achieve that, during the assembly of one module on top of another one, the approximation is as close as possible. It is the actual shape of the support cones of the upper module which directs each of these four points until they are located exactly on the conical gaps of the lower module. A perfect tonguing and grooving is thus achieved, which ensures that both parts are perfectly aligned at the base.

3—Embedment:

This design of the supports allows an embedment between modules preventing any involuntary movement with respect to one another, since the horizontal and vertical movements are restricted. This clamping between parts is implemented by the inclusion of high-resistance mortar between the support cone of the upper module and the conical gap of the lower module; said mortar is poured from the upper conical gap and flows, through the filling conduit, in a downward direction through the pillar; the clearance between the conical support and the conical gap is this filled, ensuring the non-inclusion of air, which is achieved as a result of another discharge conduit which expels any air bubble in an upward direction.

To prevent mortar from being accidentally poured through the conduit for air removal, the inlet of the mortar conduit is circularly designed so that the pouring funnel fits perfectly therein; the outlet mouth of the other tube is square and smaller so that the operator cannot accidentally join the funnel therein.

To prevent the mortar from extending beyond the strictly necessary area, flexile plastic rings are provided around the support cones so that, as a barrier, they prevent the fluid from spilling in an uncontrolled manner. Furthermore, to facilitate the mortar filling the gaps between both modules, the rod incorporates at its lower area a groove which allows the flow of mortar inside the orifice of the perforated flat of the lower module.

The mortar must be poured once the module has been leveled.

4—Leveling:

The advantage of the system is that said leveling can be carried out from the upper area of the module, which on one hand prevents the fact of having to access the inside of such module, and at the same facilitates and makes the assembly process more comfortable. The leveling is obtained by means of the leveling screw, located in the upper conical gap, and fixed to the perforated metal flat with a thread. When said screw is tightened, it pushes the central rod traversing the entire pillar and which is inserted into the metal sleeve to make its movement independent from the rest of the structure. Said vertical push involves the module rising in that corner; similarly, if the screw is loosened, it is achieved that inside of rising, the module moves slightly downwards in that corner. Given that said margin of movements exists in each of the MPPs of s module, it can be perfectly leveled without any restriction.

5—Binding:

When all the modules of one and the same floor are perfectly placed and leveled, they are bound at the head by means of pre-stressed screws which are located in the receptacles and the high-resistance mortar is poured in their joints. Firstly, the gap between the support cone and the conical gap is concreted through the MPP and then the pouring is carried out between the reinforcement connection boxes of the wet joints between internal pillars.

6—Fixing Façades and Balconies:

The MPP incorporates receptacles which, in addition to attaching the modules, also serve for attaching façade panels or balcony modules.

In the execution of the assembly, the lifting is generally with a crane, by means of lifting rockers ensuring the horizontality of the modules at all times. Said rockers are metal reinforcements the securing points of which outline a homothetic rectangle at the floor of each module. The lashing to the corners thereof is by means of the lifting tool of each of the MPPs.

Once on site, and after disassembling the goods, the assembly of the modules follows a process which can be simplified as follows:

a) Lifting and Placement.

Each module fits perfectly with that which is arranged under it (or with the support beams of the first floor, where appropriate). The location on the floor is therefore accurate and perfect.

A special tool is used to lift the dwelling and roof modules. This tool is especially designed to be coupled to the upper cone of the MPP of the dwelling and roof modules, being hooked to the leveling screw which is threaded in the metal flat of the MPP.

The main body has an end in which the lifting slings or chains are hooked. This body incorporates a handle surrounded by a main spring. The rotation of the handle actuates the upward vertical movement of the mobile body compressing the main spring, and laterally moving the fitting elements, which will make the 4 secondary springs lose tension according to the rotation of the handle.

In a normal state, the main spring is relaxed and the position of the handle keeps the mobile body in its lowest possible position. This position keeps the fitting elements far from one another, and the secondary springs forced.

In the fitting elements, when they are extended, i.e., in a normal state, the perfect contact with the inclined surface the MPP prevents to tool from being able to be inclined, always keeping it in a vertical state, which is essential for the screw of the MPP to not bend and to be able to fulfill its subsequent leveling mission. Furthermore, its position makes it impossible for the tool to embrace the head of the screw.

When the handle is rotated by an operator, it moves the mobile body upwards, which makes the secondary springs return to their normal state, joining the fitting elements. This rotation makes the tool be able to be introduced in the screw of the MPP. When the operator releases the handle, the main spring tends to be decompressed, which moves the handle, generating the movement of the mobile body to its lowest state, making the system return to its normal state, gripping the head of the screw of the MPP.

In short, the module is lifted by its four corners, being anchored to the MPP by its leveling screws.

This system has the following advantages:

Once it embraces the screw, it is impossible for it to be opened during the transport operations.

The tool cannot be involuntarily released or incorrectly placed.

In addition to fitting in the stem and head of the screw, it also presses the inclined surfaces of the cone of the MPP, preventing the existence of clearances and the horizontal pushes from causing the screw of the MPP to bend.

b) Leveling.

In the event that it was necessary to level the module, which would have to be checked by topographical means, it would be carried out as explained in relation to the MPP; i.e., each module would be leveled from its upper part by means of tightening or loosening the leveling screw.

c) Concreting of Connections.

The connections between the dwelling modules are of three different types:

Vertical connection,

Horizontal connection at the head of the pillar

Horizontal connection in the face of the pillar.

Vertically, the modules are supported on one another as a result of the functions of the Multi-purpose Pillar Part explained above.

In turn, the horizontal connection is carried out in two ways: by means of a mechanical binding at the head of the pillar based on screws fixing to one another the receptacles of the MPPs of two modules parallel to one another (or independent receptacles embedded in the center of a longitudinal beam in the case of modules perpendicular to one another), and by means of a wet joint created in the face of the pillar between two pillars of two contiguous modules opposed to one another.

Said joint is formed by the space created by two reinforcement connection boxes, one in the pillar of each module, opposite to one another; such that a vertical space is created through which, after the location of the modules in their exact position, the two pillars are made integral with one another; this is achieved by pouring a high-resistance mortar which vertically fills said gap between the flexible reinforcement loops of the reinforcement connection boxes, and thus assembling both pillars. In parallel to the sides of the reinforcement connection boxes, in an upward to downward direction, hermetic bands are embedded in the pillar, which bands prevent said mortar from flowing out of the vertical strip which is to be filled. With these two horizontal connections, a greater structural rigidity of the assembly of the building is achieved, upon working under traction, horizontal shear and vertical shear.

As regards the attachments between roof modules, for the horizontal connections, in addition to the mechanical screwing through the receptacles of the MPP, copings will also be used, which copings will have housings for mechanically fixing the floor plates.

As regards the attachment between dwelling modules and balcony modules, the anchoring between both modules is carried out by means of screws, as has already been mentioned above.

Both modules are thus assembled from the factory.

d) External Joint Covers.

To prevent the entrance of air or water between the upper separations of the modules and to assure the user of a dwelling that the latter will not be affected by water leaks in upper floors, rubber seals are placed which, coupled to the profiles embedded in the beams, provide tightness to each dwelling and to each floor. Said joint covers channel any moisture to the areas adapted to the downpipes, located in the meeting points of four pillars, to prevent water from stagnating between floors.

e) Removal of Screws.

Once the mortar has set and it can be assured that its resistance is the necessary one, the leveling screws are unscrewed, which screws no longer have any functions because the modules rest on the hardened mortar.

f) Connection of Installations.

When the assembly of a floor has already finished, the connections of the installations can then be joined, although in some case it is recommended to wait until the building is completely assembled. Said joinings, made in holes which are covered or non-visible, are quick-type joinings, by means of bushings, flexible connectors, direct links and other type of attachments.

g) Internal Joint Covers.

Finally, the internal trims are placed from the inside of the habitable areas, which trims serve to camouflage or conceal the inevitable joints between modules, both in partitions and in the floor and roof.

After the description of the invention, it can be observed that it has a series of advantages over the drawbacks of the closest state of the art, where the module basically has two main components or materials: concrete and metal ribs.

The document mentioned in the background of the invention does not make any reference to the transport of the modules, where each of said modules would have a weight of about 40 t. Said document also does not indicate how the modules are raised or lifted, or where they are hooked for their transport and placement. Likewise, there is no description of the system for the connection with the balcony.

In addition, the assembly of the modules requires auxiliary systems for the leveling, such as hydraulic jacks and mortar filling systems.

Against these drawbacks, the present invention proposes a modular constructive system for constructing a complete building comprising roofs and balconies. The dwelling modules have an independent roof, which facilitates the installations of the module.

The weight of the dwelling module of the invention is 24 t, therefore they can be transported by conventional modules.

The constructive system is simpler, because the guiding of connections, embedment, fixing and leveling is carried out by the MPP.

The assembly is also simpler, because mortar must only be poured through the MPP and in the reinforcement connection boxes; it does not require auxiliary systems such as hydraulic jacks or others.

The connections of the system of the present invention provide the constructed building with a more monolithic nature.

BRIEF DESCRIPTION OF THE DRAWINGS

A series of drawings is very briefly described below which aid in better understanding the invention and are expressly related to an embodiment of said invention which is set forth as a non-limiting example thereof.

DESCRIPTION OF A PREFERRED EMBODIMENT OF THE INVENTION

Figure 1:
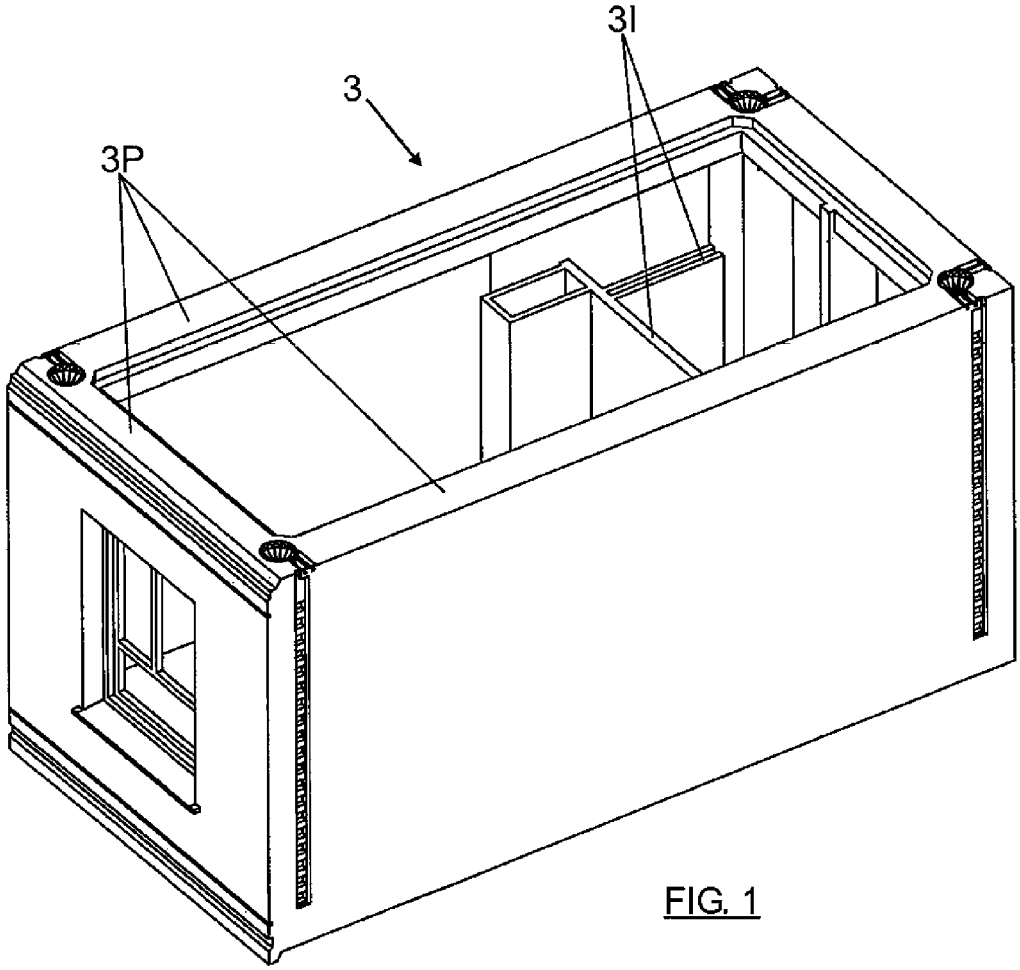
FIG. 1 is a perspective view of a dwelling module showing the perimetrical partitions and the internal partitions.
Figure 2:
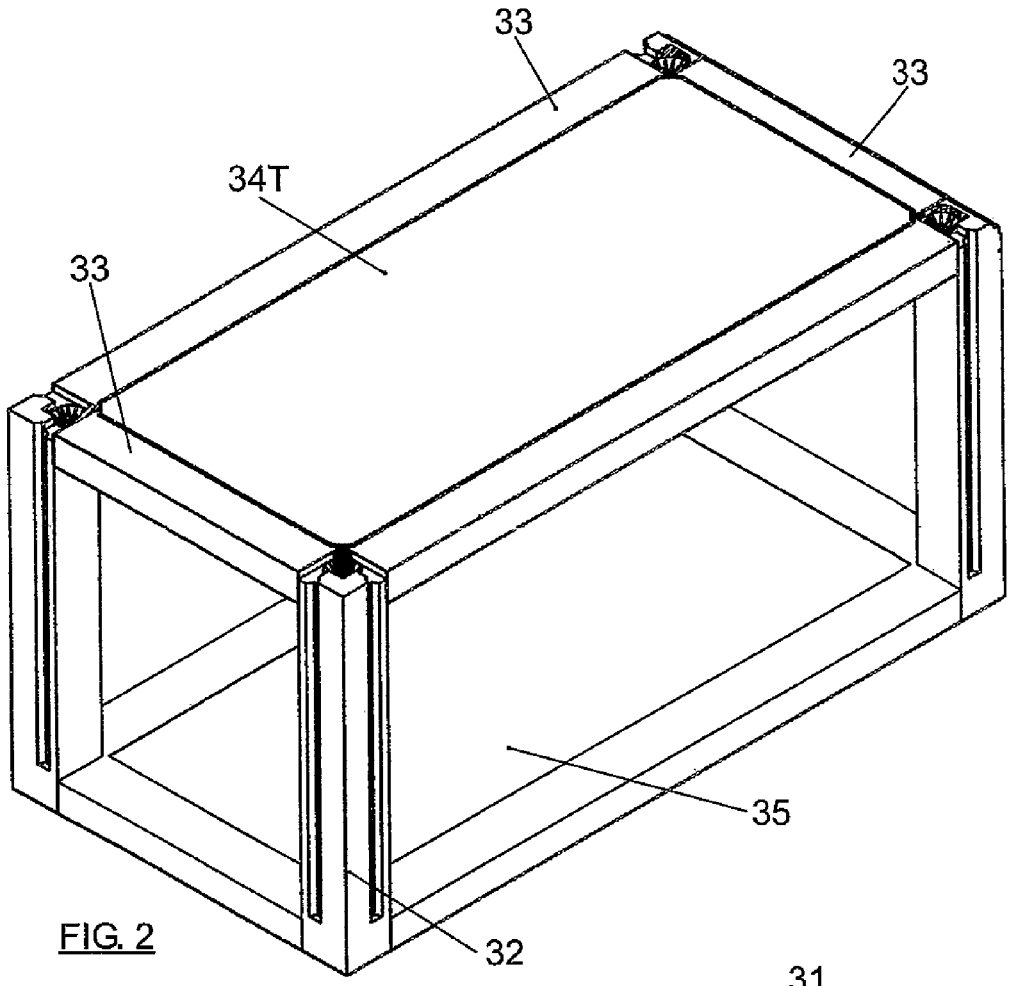
FIG. 2 is a perspective view of a dwelling module showing the basic components of the module: the floor, the roof, the pillars, the longitudinal upper beams and the transverse upper beams.
Figure 3:
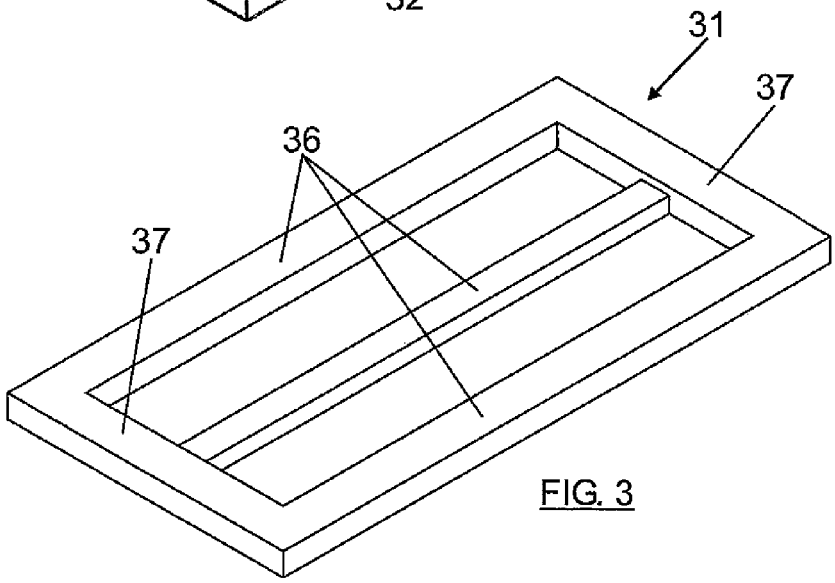
FIG. 3 is a perspective view of the floor showing the floor slab, the longitudinal lower beams and the transverse lower beams.
Figure 4:
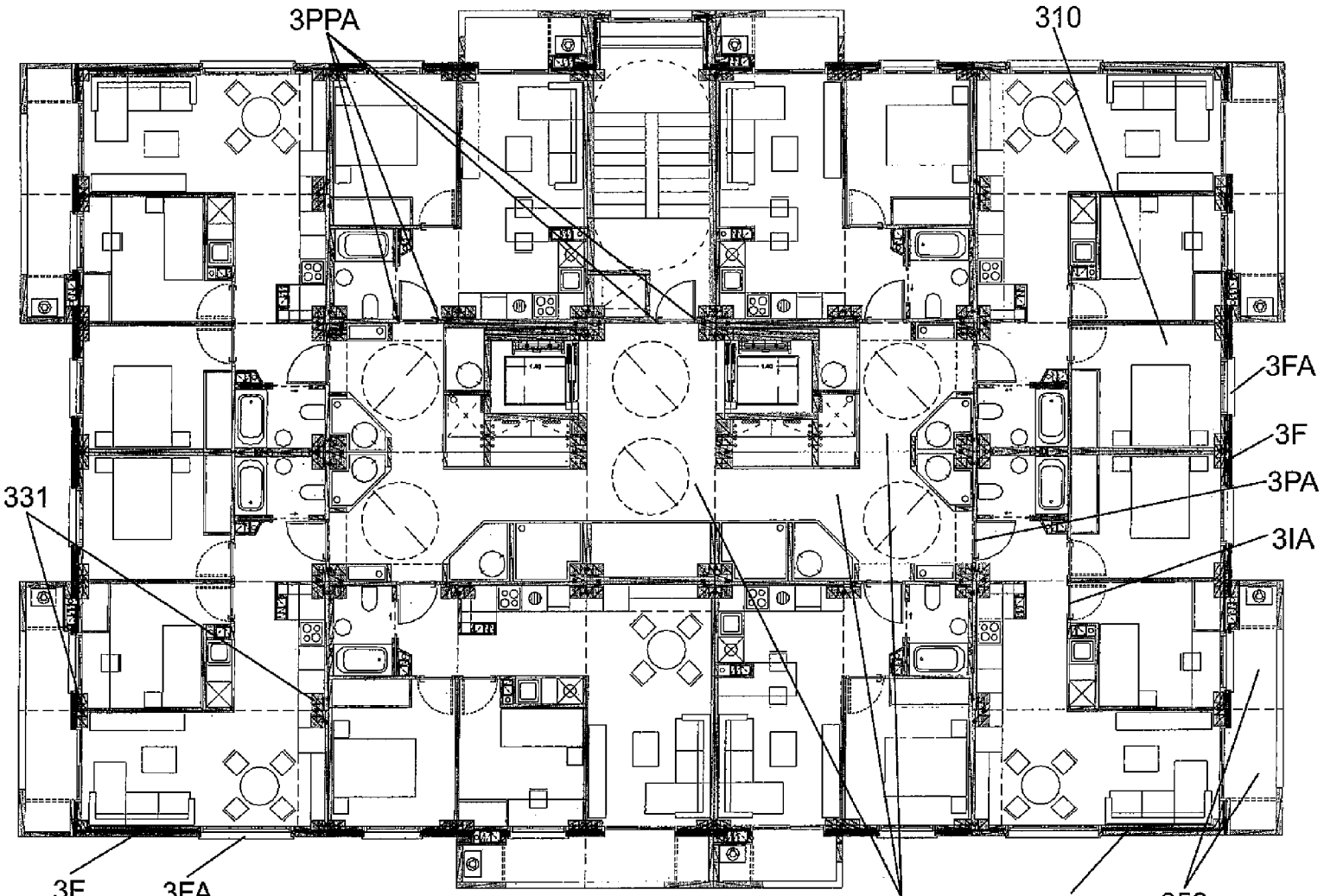
FIG. 4 is a plan view of a building showing façade modules, corner modules, internal modules, openings in perimetrical partitions, internal partitions and façade walls.
Figure 5A:
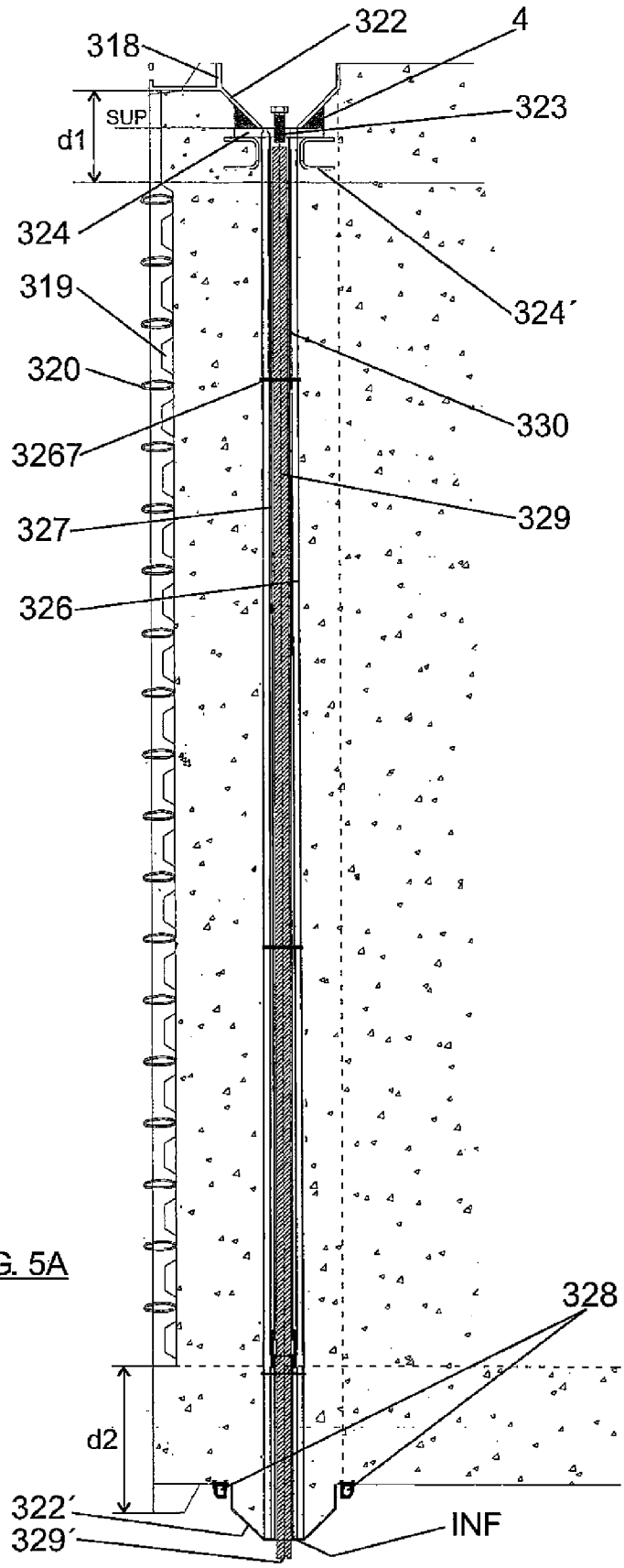
FIG. 5A is a longitudinal section of the pillar showing the multi-purpose part having the downward mortar conduit, the upward mortar conduit, the conduit clamp, the central rod, the vertical sleeve and other elements of the pillar.
Figure 5B:
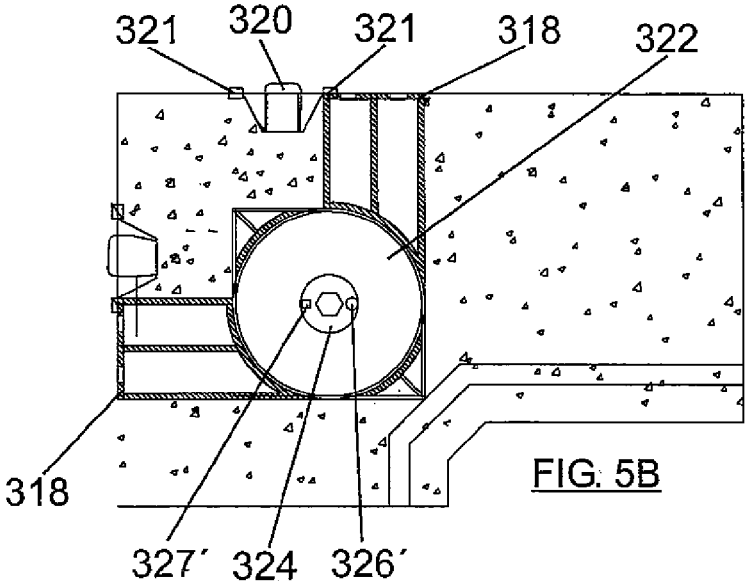
FIG. 5B is a plan view of the pillar showing the upper part of the multi-purpose part.
Figure 5C:
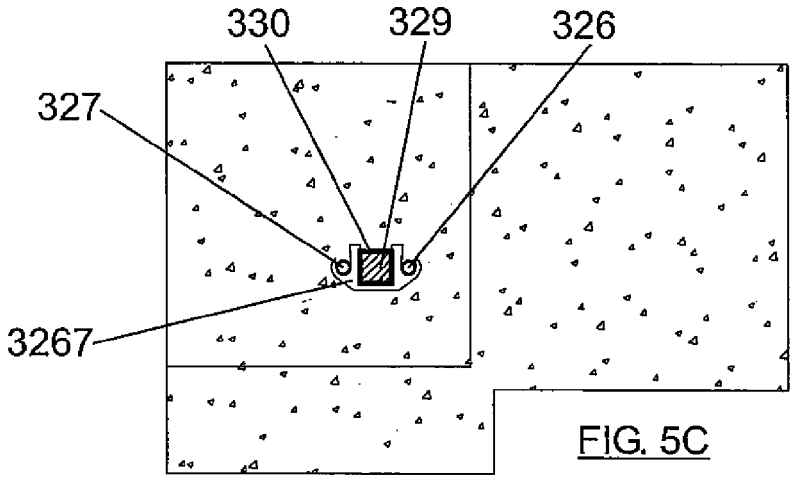
FIG. 5C is a cross-section of the multi-purpose part showing the securing of the downward and upward mortar conduits to the vertical sleeve of the central rod.
Figure 5D:
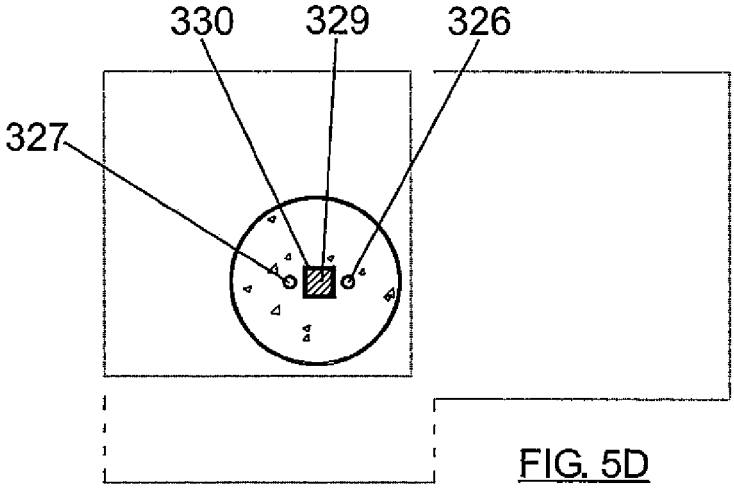
FIG. 5D is a plan view of the pillar showing the lower part of the multi-purpose part.
Figure 5E:
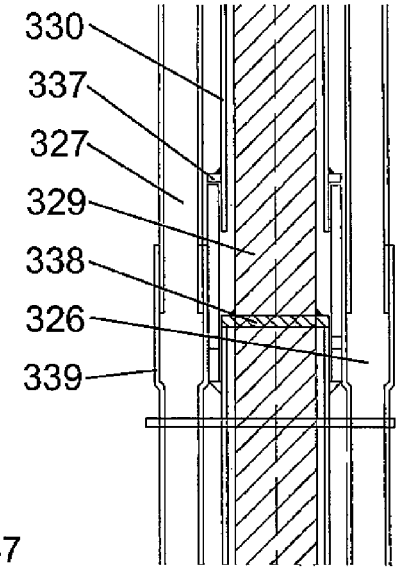
FIG. 5E is a plan view of the central part of the multi-purpose part.
Figure 6A:
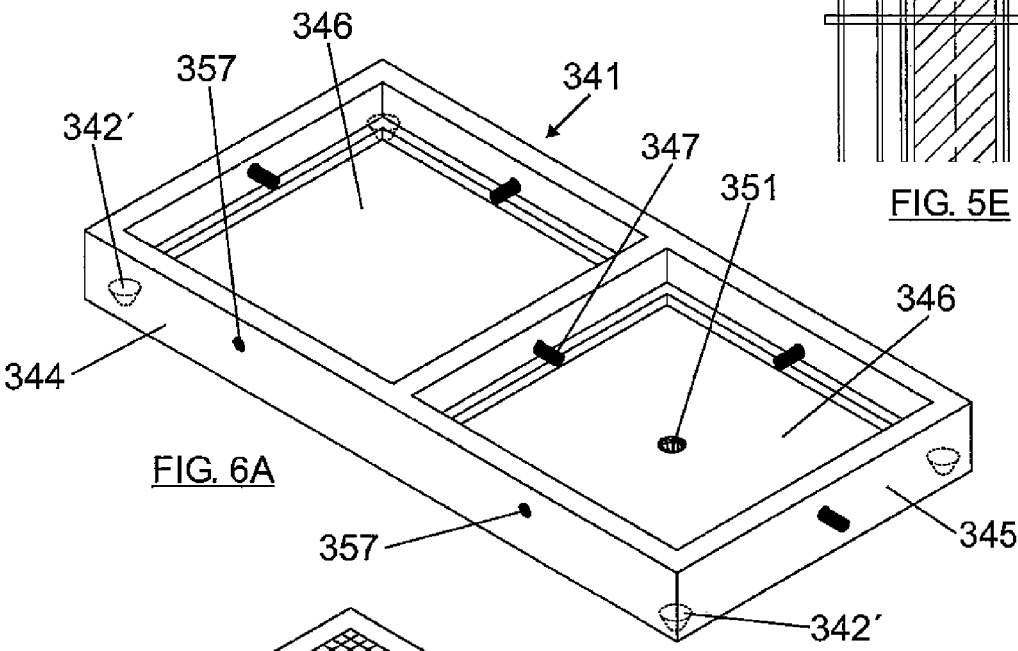
FIG. 6A is a perspective view showing a roof module.
Figure 6B:
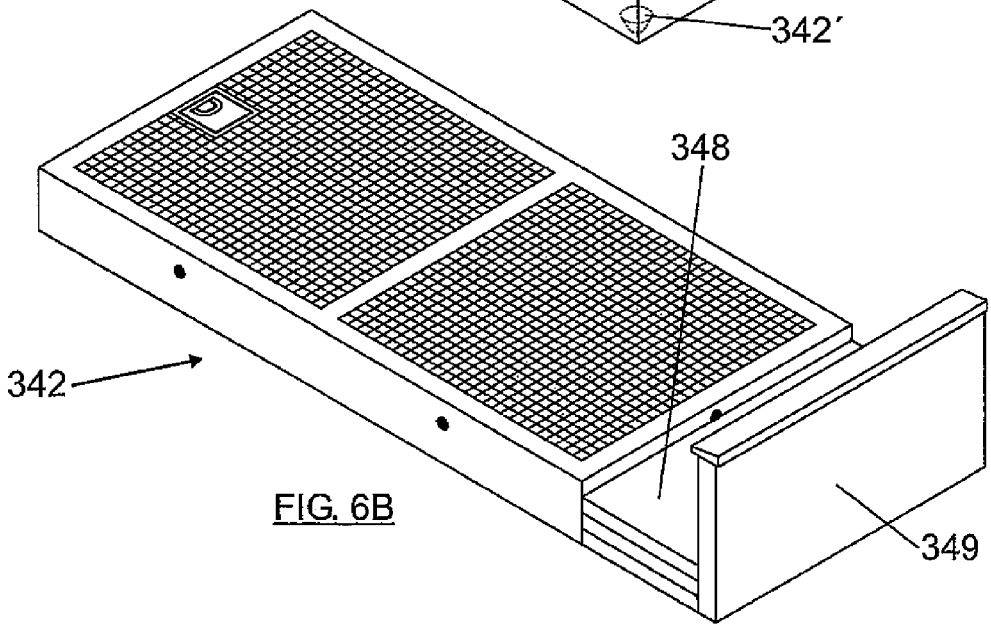
FIG. 6B is a perspective view showing a roof plate with barrier.
Figure 6C:
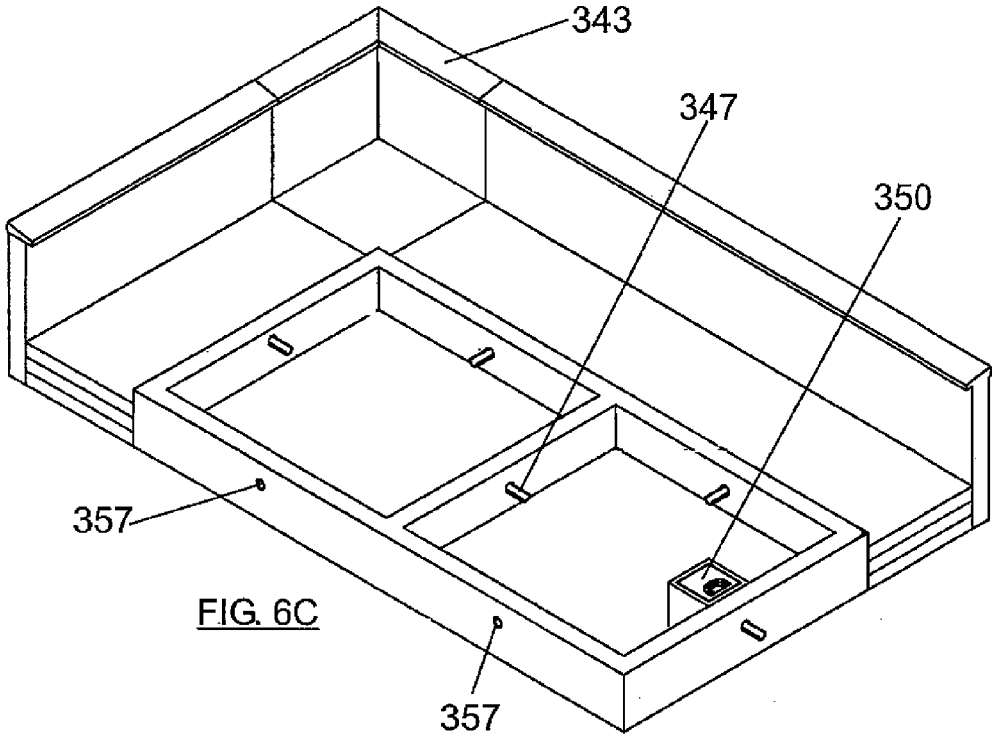
FIG. 6C is a perspective view showing a roof plate with barrier and with corner barrier.
Figure 7:
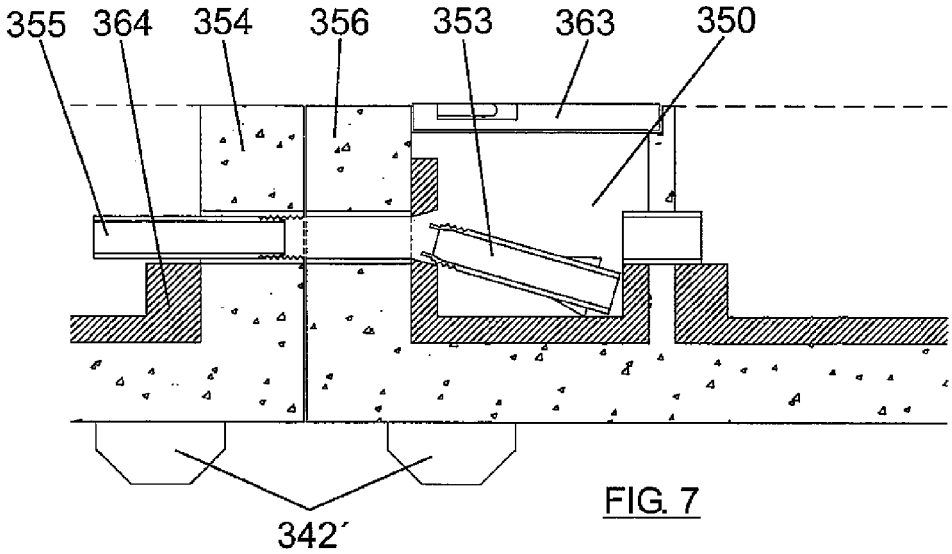
FIG. 7 is a section view showing the connection between roof plates.
Figure 8:
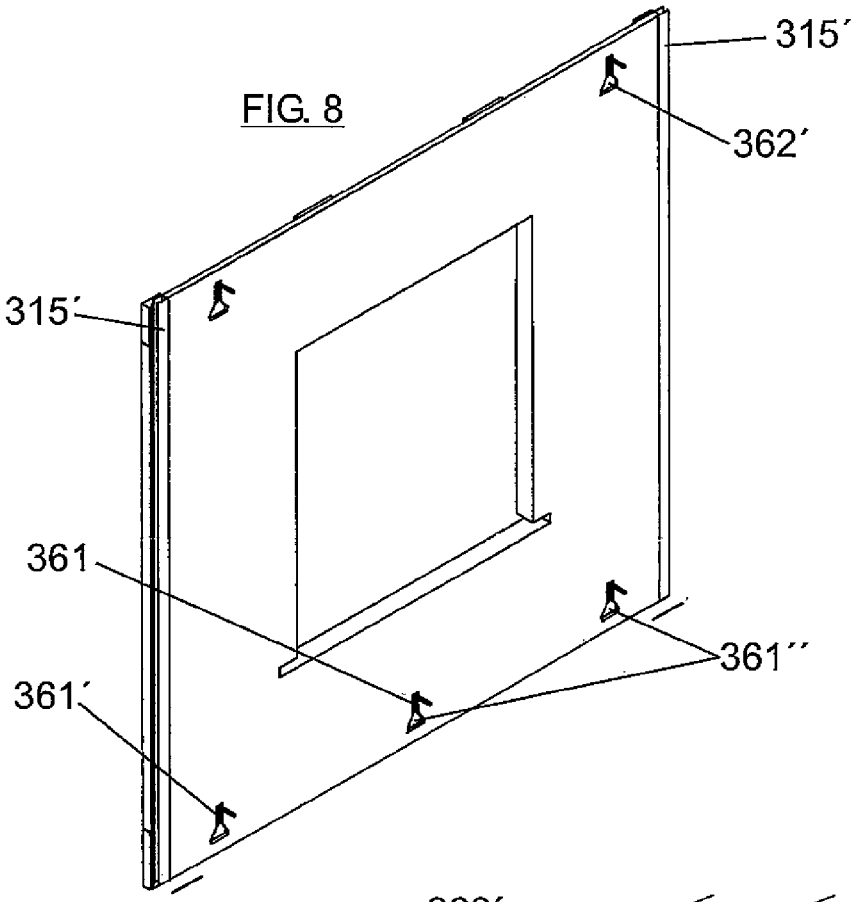
FIG. 8 is a perspective view of the attachment of an external module to a dwelling module.
Figure 9:
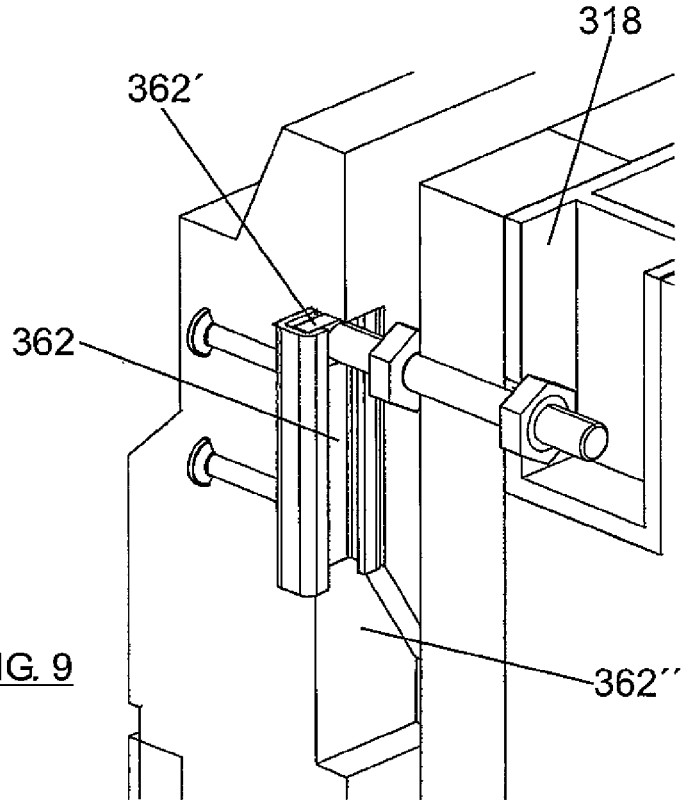
FIG. 9 is a detailed view of the external module-dwelling module attachment.
Figure 10:
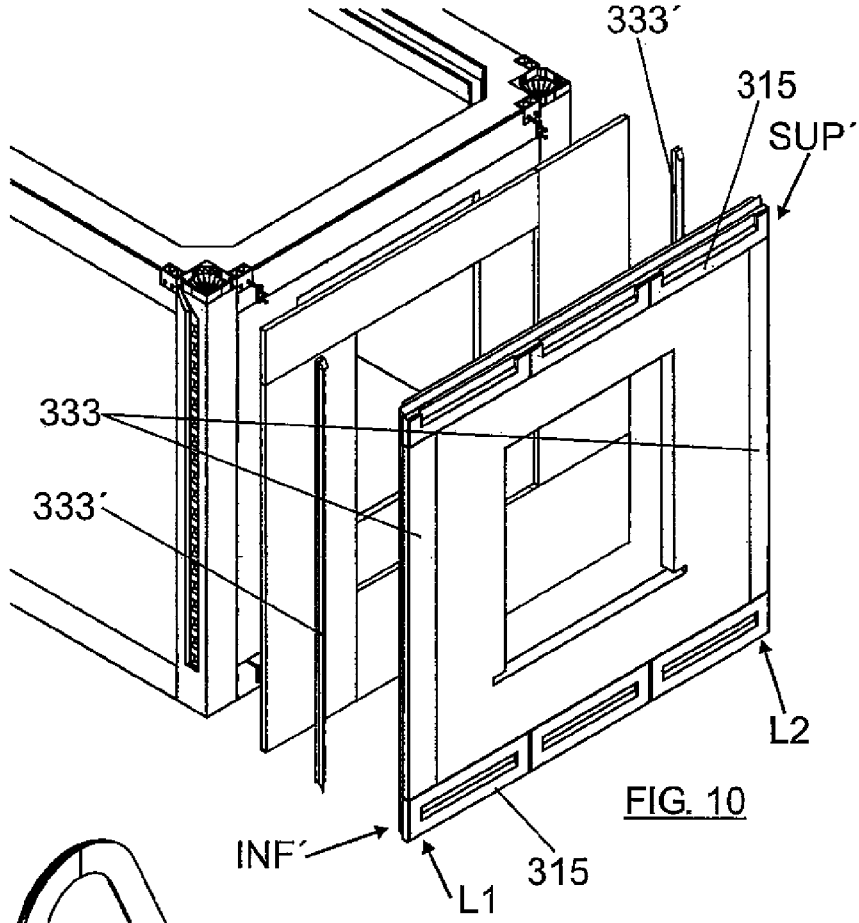
FIG. 10 is a perspective view of a façade module to be coupled on a dwelling module.
Figure 11A:
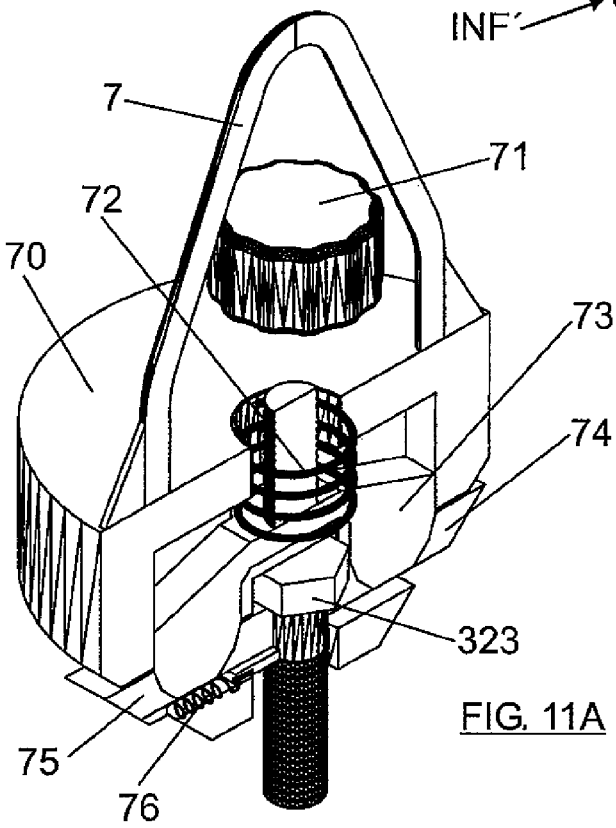
FIG. 11A is a sectioned perspective view of the lifting tool.
Figure 11B:
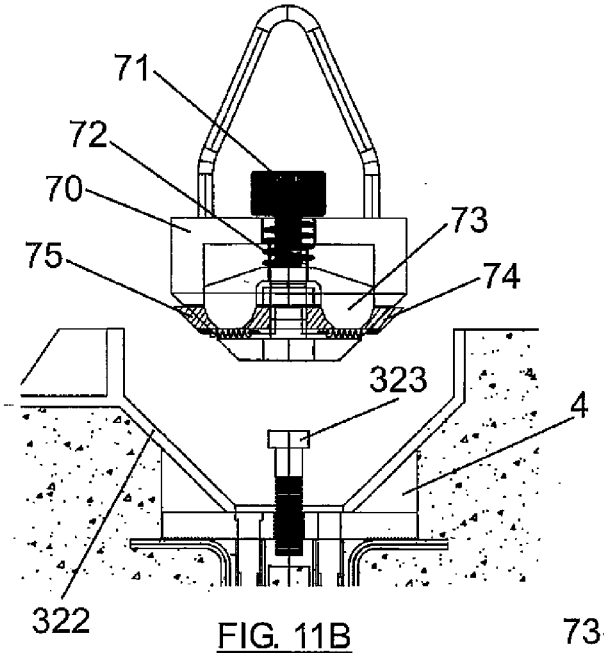
FIG. 11B is a longitudinal section of the lifting tool close to the multi-purpose pillar.
Figure 11C:
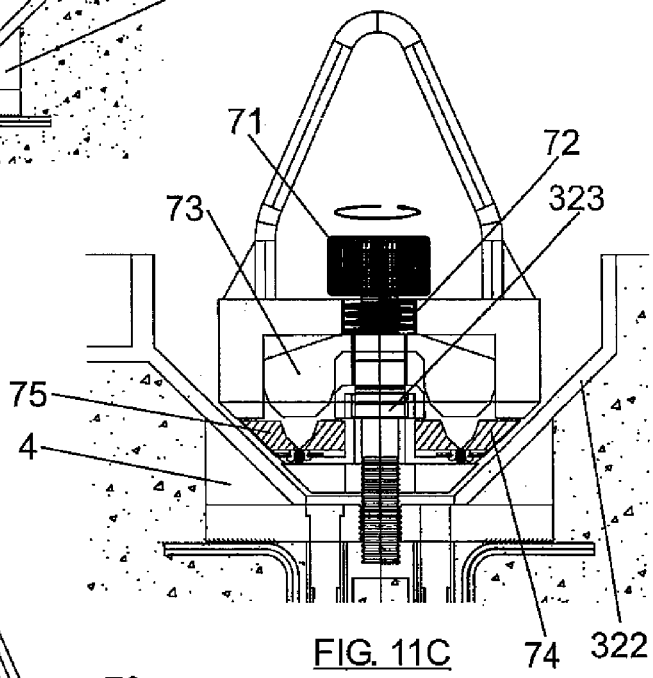
FIG. 11C is a longitudinal section of the lifting tool in a tightened state.
Figure 11D:
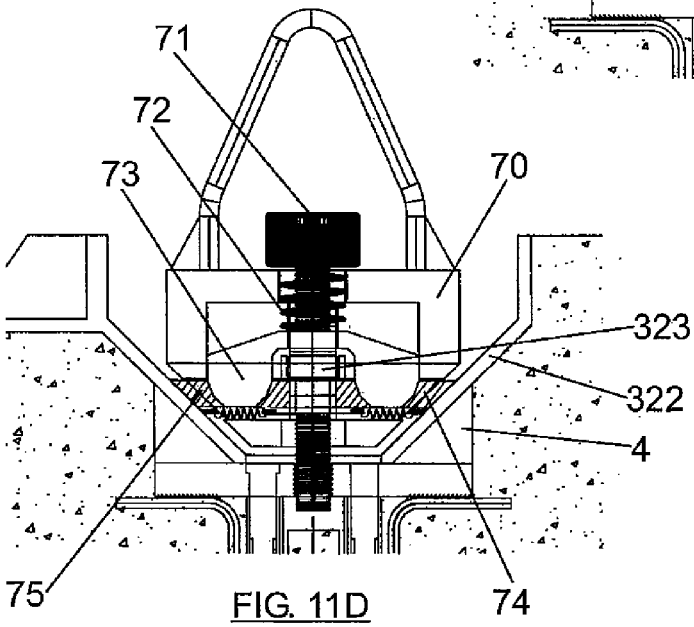
FIG. 11D is a longitudinal section of the lifting tool in a lifted state.

A first embodiment of the invention relates to a stackable parallelepiped dwelling module (3) to form a building, characterized in that it can comprise:

a floor (31);

a roof (34T);

a plurality of pillars between the floor (31) and the roof (34T), a multi-purpose part (32) being embedded in each pillar, which multi-purpose part has:

a frustoconical projection (322') at a lower end INF;

a first frustoconical housing (322) at an upper end SUP, configured to correspond with the frustoconical projection (322') and facilitate a stacking and placement of one module on top of another by means of a close approximation and a tonguing and grooving ensured by an alignment of both modules at the base.

The floor (31) can comprise:

a plurality of longitudinal lower beams (36);

a plurality of transverse lower beams (37);

a floor slab (35) coupled on the longitudinal lower beams (36) and the transverse lower beams (37);

wherein two longitudinal lower beams (36), those located on each larger side of the floor (31), and two transverse lower beams (37), those located on each smaller side of the floor (31), form perimetrical lower beams (36, 37).

The floor (31) can have three longitudinal lower beams (36), a longitudinal lower beam (36) on each larger side of the floor (31) and a longitudinal lower beam (36) in a midplane of the floor (31).

Likewise, the floor (31) can have two transverse lower beams (37), one on each smaller side of the floor (31).

In addition, the roof (34T) can comprise:

a plurality of longitudinal upper beams (33);

a plurality of transverse upper beams (33');

a roof slab supported on the longitudinal upper beams (33) and the transverse upper beams (33');

wherein two longitudinal upper beams (33), those located on each larger side of the roof (34T), and two transverse upper beams (33'), those located on each smaller side of the roof (34T), form perimetrical upper beams (33, 33').

The roof (34T) can have two longitudinal upper beams (33), a longitudinal upper beam (33) on each larger side of the roof (34T).

Likewise, the roof (34T) can have two transverse upper beams (33'), one on each smaller side of the roof.

The dwelling module (3) of the invention can comprise four multi-purpose parts (32), one at each corner of the dwelling module (3).

The dwelling module (3) can additionally comprise at least one multi-purpose part (32) located in a position between the corners, said position being selected from:

from a transverse upper beam (33') to a transverse lower beam (37);

from a longitudinal upper beam (33) to a longitudinal lower beam (36);

and combinations thereof.

Likewise, the dwelling module (3) can comprise horizontal fitting means located in a position between the corners, said position being selected from:

in a longitudinal upper beam (33);

in a transverse upper beam (33');

and combinations thereof;

said horizontal fitting means comprising:

at least one fitting receptacle (318) configured to receive fixing screws (331) connecting with a perforated receptacle (318) of an adjacent multi-purpose part (32) to horizontally join two modules.

The dwelling module (3) of the invention, wherein the pillar has a height h from an upper end SUP to a lower end INF, can further comprise second horizontal fixing means comprising:

a vertical groove from a point located at a distance d1≧0.06h from the upper end to a point located at a distance d2≧0.10h from the lower end to be filled with mortar which has:

a plurality of merlons or reinforcement connection boxes (319);

a plurality of flexible reinforcements (320) intercalated with the merlons (319);

a hermetic band (321) at each edge of the vertical groove to prevent the mortar from overflowing said edges.

The dwelling module (3) of the invention can further comprise partitions selected from perimetrical partitions (3P), internal partitions (3I) and combinations thereof to configure a distribution of the dwelling.

The dwelling module (3) of the invention can further comprise an opening (3PA, 3IA) having mobile panels between a open position and a closed position in at least one partition (3P, 3I).

In this case, the dwelling module can also comprise internal profiles (3PPA) embedded in frames of first module-module connecting opening (3PA) to house joint covers and prevent the joint between two contiguous modules from being visible.

The dwelling module (3) can additionally comprise a façade wall (3F) in a perimetrical partition (3P) to form a façade module (310).

If the dwelling module (3) comprises two façade walls (3F) in two contiguous perimetrical partitions (3P), it then forms a corner module (309). Thus, a floor of a building can be formed from façade modules (310), corner modules (309) and internal modules (311).

The dwelling module (3) can optionally further comprise a second opening (3FA) having mobile panels between an open position and a closed position in at least one façade wall (3F).

In addition, aforementioned multi-purpose part (32) can further comprise:

a downward mortar conduit (326) from an upper end SUP to a lower end INF of the pillar to introduce mortar;

a upward mortar conduit (327) from the lower end INF to the upper end SUP of the pillar so that the mortar introduced rises until filling a cavity defined by the mortar conduits (326, 327), the frustoconical housing (322) and the frustoconical projection (322').

This multi-purpose part (32) can further comprise:

a central rod (329) from the upper end SUP to the lower end INF, said rod comprising a groove (329') at the lower end INF to allow a mortar flow;

a vertical sleeve (330) enveloping the central rod (329);

at least one conduit clamp (3267) to secure the conduits (326, 327) to the vertical sleeve (330) between the upper end SUP and the lower end INF.

The central part of the multi-purpose part (32) is the intercommunicator of the upper cone and of the lower cone. It is formed by 2 circular tubes (326, 327) and a central square bar steel (330).

The central square bar steel (330), contains the leveling rod (329), and the 2 side tubes (326, 327) are useful for the mortar to communicate the 2 cones. This part of the MPP is divided into 2 parts, due to the fact that the concreting process is carried out in two phases: first the floor and then the elevations (pillars, upper beams and walls).

Therefore, the lower section of said sleeve ends with a wider tube so that the second sleeve section is coupled therein. In this second section, fixing stops (337, 338) are fixed so that there is a clearance between the two sections, which allows the rod to move upwards or downwards. The latter is turn has other stops preventing the rod from falling and coming out of the pillar while lifting the module. A similar joining is carried out with the tube for filling with mortar and the air discharge tube, which have a coupling nozzle (339) to ensure the continuity thereof.

Additionally, the multi-purpose part (32) can further comprise at the upper end SUP:

a perforated metal flat (324) having:

a first threaded central perforation configured to receive a leveling screw (323);

a second perforation (326') coinciding with the downward mortar conduit (326);

a third perforation (327') coinciding with the upward mortar conduit (327);

a second corrugation (324') embedded in the pillar and welded to the perforated metal flat (324).

Likewise, in the multi-purpose part (32):

the second perforation (326') can have a round shape configured to receive a mortar pouring funnel;

the third perforation (327') can have a square shape and a smaller dimension than the second perforation (326') to prevent a mortar pouring funnel from being coupled to the third perforation (327').

In addition, the second corrugation (324') can have a shape selected from Z, S, L, C and J.

The multi-purpose part (32) can further comprise at the lower end INF a plurality of expansive, deformable and flexible plastic rings (328) to prevent mortar from overflowing and to ensure a hermetic coupling between the frustoconical projection (322') and the frustoconical housing (322).

Additionally, the multi-purpose part (32) can further comprise first horizontal fixing means comprising:

at least one perforated receptacle (318) at an upper end SUP configured to receive fixing screws (331) connecting with a receptacle (318) of an adjacent multi-purpose part (32) to horizontally join two modules.

Likewise, the multi-purpose part (32) can comprise at the upper end SUP:

a frustoconical metal sheet (322) having:

a smaller diameter in contact with the perforated metal flat (324), the smaller diameter containing the second perforation (326') and the third perforation (327');

a larger diameter between the edge of the upper end SUP and the smaller diameter, to define the first frustoconical housing (322).

Likewise, the multi-purpose part (32) can further comprise at the upper end SUP:

a plurality of bracing brackets (4) between the perforated metal flat (324) and the conical metal sheet (322).

The invention also contemplates a roof module configured to be coupled to a dwelling module (3) characterized in that it can comprise at least one multi-purpose part (32) having:

a frustoconical projection (322') at a lower end INF configured to correspond with the first frustoconical housing (322) at an upper end SUP of the dwelling module (3) and facilitate a stacking and placement of one module on top of another by means of a close approximation and a tonguing and grooving ensured by an alignment of both modules at the base;

a first frustoconical housing (322) at an upper end SUP.

The roof module can comprise:

a plurality of longitudinal roof beams (344);

a plurality of transverse roof beams (345);

wherein:

two longitudinal roof beams (344), those located on each larger side of the roof module, and two transverse roof beams (345), those located on each smaller side of the roof module, form perimetrical roof beams (344, 345).

The roof module can specifically have two longitudinal roof beams (344), one on each larger side of the roof module.

Likewise, the roof module can have two transverse roof beams (345), one on each smaller side of the roof module.

Additionally, the roof module can comprise at least one basin (346) formed between the longitudinal beams (344) and the transverse beams (345).

The roof module can further comprise:

at least one longitudinal roof beam (344) between those located on each larger side of the roof module to form an intermediate or internal longitudinal roof beam (344) and define at least two basins (346).

Likewise, the roof module can also comprise:

at least one transverse roof beam (345), between those located on each smaller side of the roof module to form an intermediate or internal transverse roof beam (345) and define at least two basins (346).

In addition, in the roof module, at least one intermediate longitudinal roof beam (344) can comprise at least one first weep hole (347) configured to communicate two basins (346) and allow a transfer of a fluid from a first basin (346) to a second basin (346).

Similarly, in the roof module at least one intermediate transverse roof beam (345) can comprise at least one first weep hole (347) configured to communicate two basins (346) and allow a transfer of a fluid from a first basin (346) to a second basin (346).

The roof plate (341) can further comprise a downpipe orifice (351) to discharge a fluid from a basin (346).

Likewise, the roof plate can further comprise a barrier in a beam selected from a transverse beam (345) and a longitudinal beam (344) of a façade end, to form a roof plate with barrier (342), wherein said barrier is formed by an L-shaped projecting ledge having:

a horizontal portion (348) for the passage of people;

a vertical barrier (349);

to provide an eave to a building.

Additionally, the roof plate with barrier (342) can comprise a box (350) in the transverse beam (345) opposite to the transverse beam (345) having the barrier, to transfer a fluid from a origin plate (356) to a destination plate (354).

The roof plate with barrier (342) can also comprise a corner barrier (343) to form a peripheral ledge together with the roof plates with barrier (342).

The roof plate (341) can optionally further comprise at least one second weep hole (357) in each longitudinal beam (344) to connect adjacent roof plates (341) and transfer a fluid from an origin plate (356) to a destination plate (354).

The roof plate (341) can further comprise a rainwater filtering system formed by roofs selected from roofs with gardens, geotextile roofs and combinations thereof to separate the water into two levels:

an upper level wherein the water is stored to thermally insulate the building and moisten a plant substrate, for example, in warm periods;

a lower level wherein the water is transferred by means of an element selected from the downpipe orifice (351), the first weep hole (347), the second weep hole (357), the box (350), and combinations thereof.

The second weep hole (357) between adjacent roof plates (341) can comprise fluid conducting means without leaks or loss comprising connecting means selected from:

threading between a connecting tube (353) and the destination plate (354);

tonguing and grooving between a connecting tube (353) and a reinforcement connection tube (355) of the destination plate (354);

embedment of the connecting tube (353) in the origin plate (356);

and combinations thereof.

The roof module of the invention can comprise:

a plurality of roof plates (341);

a plurality of roof plates with barrier (342);

a plurality of corner barriers (343);

located contiguously to form a roof of a building.

The invention also relates to an external modules selected from:

a balcony module (359) to define a balcony; and a façade module (310) to define a ventilated façade;

having:

an inner face configured to be coupled in a projecting manner to a dwelling module (3); and an outer face opposite to the inner face;

characterized in that it can comprise third horizontal fixing means in the inner face comprising:

at least one support guide (361) configured to house a head of a support screw (361') having a stud embedded in a transverse lower beam (37);

at least one anti-overturn guide (362) configured to house a head of an anti-overturn screw (362') fixed to the receptacle (318). With this configuration, a façade module (310) or balcony module (359) is hung with a support guide (361) and an anti-overturn guide (362), arranging one guide on each side of the module. Another configuration can comprise two support guides (361) and two anti-overturn guides (362), arranging one support guide (361) and one anti-overturn guide (362) on each side.

The external module (359, 310) can further comprise:

a trapezoidal support opening (361") converging towards the support guide (361), configured to facilitate an entrance of the head of the support screw (361') in the support guide (361).

The external module (359, 310) can further comprise:

a trapezoidal anti-overturn opening (362") converging towards the anti-overturn guide (362) configured to facilitate an entrance of the head of the anti-overturn screw (362') in the anti-overturn guide (362).

In the external module (359, 310) of the invention, an element selected from the anti-overturn guide (362), the support guide (361) and combinations thereof can have a direction selected from parallel to the multi-purpose parts (32) and parallel to the floor (31).

The external module (359, 310) can also comprise a horizontal impost (315) in the outer face in a site selected from upper SUP', lower INF' and both.

Additionally, the external module (359, 310) can further comprise an element selected from a vertical impost (333), a waterproofing and insulating vertical band (333') and combinations thereof, in the outer face, in a site selected from a first side L1, a second side L2 and both sides.

Likewise, the external module (359, 310) can comprise an embedded vertical profile (315'):

in a site selected from a first side L1, a second side L2 and both sides of the external module (359, 310);

to fix the waterproofing and insulating vertical band (333') between two embedded vertical profiles (315') of two contiguous external modules (359, 310).

The invention also includes a building comprising at least one dwelling module (3) and at least one roof module as has been described above.

The building can further comprise at least one external module as that described above. Alternatively, the building can directly have the dwelling module (3) on the façade, without the need to incorporate façade modules (310) or balcony modules (359).

The invention also relates to a lifting tool for a module selected from a dwelling module (3) and a roof module, said tool having a main body (70) which can comprise:

a hook (7):

on an upper face of the main body (70);

configured so that the lifting tool is suspended by lifting means;

coupling means (74, 75) comprising:

a first surface configured to be coupled with a leveling screw (323);

a second surface configured to be coupled with a frustoconical housing (322);

opening and closing means configured to move the coupling means (74, 75) in a first plane between:

a rest position, to allow an approximation and placement of the tool in the frustoconical housing (322) and a adjustment position, in which the coupling means (74, 75) are retracted to allow a coupling of the tool to the leveling screw (323) and to the frustoconical housing (322);

a tightening position, in which the coupling means (74, 75) are coupled to the leveling screw (323) and to the frustoconical housing (322);

first return means, which can be formed by secondary springs (76) to ensure that the coupling means (74, 75) are in the rest position, in the absence of actuation on the opening and closing means.

The opening and closing means can comprise:

a mobile body (73) movable in a direction substantially perpendicular to the first plane between a released position and an actuated position to move the coupling means (74, 75) between the rest position, the adjustment position and the tightening position, wherein:

the coupling means (74, 75) are in the rest position when the mobile body is in the released position;

the coupling means (74, 75) are in the adjustment position when the mobile body is in the actuated position;

the coupling means (74, 75) are in the tightening position when the mobile body is in the released position;

handling means (71) to move the mobile body (73) from the released position to the actuated position;

second return means (72) to ensure that the mobile body (73) is in the released position in the absence of actuation on the handling means (71).

the invention also includes a packaging for a dwelling module (3) which can comprise an internal membrane:

having securing means to be connected to a plurality of internal profiles (3PPA) arranged in frames of first module-module connecting openings (3PA);

to cover mobile panels of a dwelling module (3) on site.

The packaging can further comprise an external membrane to externally cover the dwelling module (3) during storage and transport.

The invention claimed is:

1. A constructive system comprising a stackable parallelepiped dwelling module to form a building, the dwelling module comprising:

a floor;

a roof;

a plurality of pillars between the floor and the roof, a multi-purpose part embedded in each pillar, which multi-purpose part has:

a frustoconical projection at a lower end;

a first frustoconical housing at an upper end, configured to correspond with the frustoconical projection and facilitate a stacking and placement of one module on top of another by a close approximation and a tonguing and grooving ensured by an alignment of both modules at the base;

a multi-purpose part at each corner of the dwelling module, at least one multi-purpose part located in a position between the corners, said position being selected from:

from a transverse upper beam to a transverse lower beam;

from a longitudinal upper beam to a longitudinal lower beam;

and combinations thereof.

2. The constructive system of claim 1, wherein the floor comprises:

a plurality of longitudinal lower beams;

a plurality of transverse lower beams;

a floor slab coupled on the longitudinal lower beams and the transverse lower beams;

wherein two longitudinal lower beams, those located on each larger side of the floor, and two transverse lower beams, those located on each smaller side of the floor, form perimetrical lower beams.

3. The constructive system of claim 2, wherein the floor has three longitudinal lower beams, a longitudinal lower beam on each larger side of the floor and a longitudinal lower beam in a midplane of the floor.

4. The constructive system of claim 2, wherein the floor has two transverse lower beams, one on each smaller side of the floor.

5. The constructive system of claim 1, wherein the roof comprises:

a plurality of longitudinal upper beams;

a plurality of transverse upper beams;

a roof slab supported on the longitudinal upper beams and the transverse upper beams;

wherein two longitudinal upper beams, those located on each larger side of the roof, and two transverse upper beams, those located on each smaller side of the roof, form perimetrical upper beams.

6. The constructive system of claim 5, wherein the roof has two longitudinal upper beams, a longitudinal upper beam on each larger side of the roof.

7. The constructive system of claim 5, wherein the roof has two transverse upper beams, one on each smaller side of the roof.

8. A constructive system comprising a stackable parallelepiped dwelling module to form a building, the dwelling module comprising:

a floor;

a roof;

a plurality of pillars between the floor and the roof, a multi-purpose part embedded in each pillar, wherein the multi-purpose part has:

a frustoconical projection at a lower end;

a first frustoconical housing at an upper end, configured to correspond with the frustoconical projection and facilitate a stacking and placement of one module on top of another by a close approximation and a tonguing and grooving ensured by an alignment of both modules at the base;

wherein the pillar has a height h from an upper end to a lower end, second horizontal fixing means comprising:

a vertical groove from a point located at a distance $d1 \geqq 0.06h$ from the upper end to a point located at a distance $d2 \geqq 0.10h$ from the lower end to be filled with mortar which has:

a plurality of merlons;

a plurality of flexible reinforcements intercalated with the merlons;

a hermetic band at each edge of the vertical groove to prevent the mortar from overflowing said edges.

9. A constructive system comprising a stackable parallelepiped dwelling module to form a building, the dwelling module comprising:

a floor;

a roof;

a plurality of pillars between the floor and the roof, a multi-purpose part embedded in each pillar, wherein the multi-purpose part has:

a frustoconical projection at a lower end;

a first frustoconical housing at an upper end, configured to correspond with the frustoconical projection and facilitate a stacking and placement of one module on top of another by a close approximation and a tonguing and grooving ensured by an alignment of both modules at the base;

wherein the multi-purpose part further comprises:

a downward mortar conduit from an upper end to a lower end of the pillar to introduce mortar;

an upward mortar conduit from the lower end to the upper end of the pillar so that the mortar introduced rises until filling a cavity defined by the mortar conduits, the frustoconical housing and the frustoconical projection.

10. The constructive system of claim 9, wherein the multi-purpose part further comprises:

a central rod from the upper end to the lower end, said rod comprising a groove at the lower end to allow a mortar flow;

a vertical sleeve enveloping the central rod;

at least one conduit clamp to secure the conduits to the vertical sleeve between the upper end and the lower end.

11. The constructive system of claim 9, wherein the multi-purpose part further comprises at the upper end:

a perforated metal flat having:

a first threaded central perforation configured to receive a leveling screw;

a second perforation coinciding with the downward mortar conduit;

a third perforation coinciding with the upward mortar conduit;

a second corrugation embedded in the pillar and welded to the perforated metal flat.

12. The constructive system of claim 11, wherein:

the second perforation has a round shape configured to receive a mortar pouring funnel;

the third perforation has a square shape and a dimension smaller than the second perforation to prevent a mortar pouring funnel from being coupled to the third perforation.

13. The constructive system of claim 11, wherein the second corrugation has a shape selected from Z, S, L, C and J.

14. The constructive system of claim 9, wherein the multi-purpose part further comprises at the lower end a plurality of flexible plastic rings to prevent mortar from overflowing and to ensure a hermetic coupling between the frustoconical projection and the frustoconical housing.

15. The constructive system of claim 9, wherein the multi-purpose part further comprises first horizontal fixing means comprising:

at least one perforated receptacle at an upper end configured to receive fixing screws connecting with a receptacle of an adjacent multi-purpose part to horizontally join two modules.

16. The constructive system of claim 11, wherein the multi-purpose part further comprises at the upper end:

a frustoconical metal sheet having:

a smaller diameter in contact with the perforated metal flat, the smaller diameter containing the second perforation and the third perforation;

a larger diameter between the edge of the upper end and the smaller diameter, to define the first frustoconical housing.

17. The constructive system of claim 16, wherein the multi-purpose part further comprises at the upper end:

a plurality of bracing brackets between the perforated metal flat and the conical metal sheet.

18. A constructive system comprising a stackable parallelepiped dwelling module to form a building, the dwelling module comprising:

a floor;

a roof;

a plurality of pillars between the floor and the roof, a multi-purpose part embedded in each pillar, wherein the multi-purpose part has:

a frustoconical projection at a lower end;

a first frustoconical housing at an upper end, configured to correspond with the frustoconical projection and facilitate a stacking and placement of one module on top of another by a close approximation and a tonguing and grooving ensured by an alignment of both modules at the base;

a roof module configured to be coupled to a dwelling module, wherein the roof module comprises at least one multi-purpose part having:

a frustoconical projection at a lower end configured to correspond with the first frustoconical housing at an upper end of the dwelling module and facilitate a stacking and placement of one module on top of another by means of a close approximation and a tonguing and grooving ensured by an alignment of both modules at the base;

a first frustoconical housing at an upper end:

a plurality of longitudinal roof beams;

a plurality of transverse roof beams;

wherein:

two longitudinal roof beams, located on each larger side of the roof module, and two transverse roof beams, located on each smaller side of the roof module, form perimetrical roof beams.

19. The constructive system of claim 18, comprising two longitudinal roof beams, one on each larger side of the roof module.

20. The constructive system of claim 18, comprising two transverse roof beams, one on each smaller side of the roof module.

21. The constructive system of claim 18, further comprising at least one basin formed between the longitudinal beams and the transverse beams.

22. The constructive system of claim 18, further comprising:

at least one longitudinal roof beam between those located on each larger side of the roof module to form an intermediate longitudinal roof beam and define at least two basins.

23. The constructive system of claim 18, further comprising:

at least one transverse roof beam, between those located on each smaller side of the roof module to form an intermediate transverse roof beam and define at least two basins.

24. The constructive system of claim 22, wherein at least one intermediate longitudinal roof beam comprises at least one first weep hole configured to communicate two basins and allow a transfer of a fluid from a first basin to a second basin.

25. The constructive system of claim 23, wherein at least one intermediate transverse roof beam comprises at least one first weep hole configured to communicate two basins and allow a transfer of a fluid from a first basin to a second basin.

26. The constructive system of claim 18, wherein the roof plate further comprises a downpipe orifice to discharge a fluid from a basin.

27. The constructive system of claim 18, wherein the roof plate further comprises a barrier in a beam selected from a transverse beam and a longitudinal beam of a façade end, to form a roof plate with barrier, wherein said barrier is formed by an L-shaped projecting ledge having:

a horizontal portion for the passage of people;

a vertical barrier;

to provide an eave to a building.

28. The constructive system of claim 27, wherein the roof plate with barrier comprises a box placed against one of the beams of the basin opposite to the transverse beam having the barrier, to transfer a fluid from an origin plate to a destination plate.

29. The constructive system of claim 27, wherein the roof plate with barrier further comprises a corner barrier to form a peripheral ledge together with the roof plates with barrier.

30. The constructive system of claim 25, wherein the roof plate further comprises at least one second weep hole in each longitudinal beam to connect adjacent roof plates and transfer a fluid from an origin plate to a destination plate.

31. The constructive system of claim 30, wherein the roof plate further comprises a rainwater filtering system formed by roofs selected from roofs with gardens, geotextile roofs and combinations thereof to separate the water into two levels:

an upper level wherein the water is stored to thermally insulate the building and moisten a plant substrate, for example, in warm periods;

a lower level wherein the water is transferred by means of an element selected from the downpipe orifice, the first weep hole, the second weep hole, the box, and combinations thereof.

32. The constructive system of claim 30, comprising a third weep hole connected with a box, said third weep hole comprising fluid conducting means without leaks or loss comprising connecting means selected from:

threading between a connecting tube and the destination plate;

tonguing and grooving between a connecting tube and a reinforcement connection tube of the destination plate;

embedment of the connecting tube in the origin plate;

and combinations thereof.

33. The constructive system of claim 29, comprising:

a plurality of roof plates;

a plurality of roof plates with barrier;

a plurality of corner barriers;

located contiguously to form a roof of a building.

34. A constructive system comprising a stackable parallelepiped dwelling module to form a building, the dwelling module comprising:

a floor;

a roof;

a plurality of pillars between the floor and the roof, a multi-purpose part embedded in each pillar, wherein the multi-purpose part has:

a frustoconical projection at a lower end;

a first frustoconical housing at an upper end, configured to correspond with the frustoconical projection and facilitate a stacking and placement of one module on top of another by a close approximation and a tonguing and grooving ensured by an alignment of both modules at the base;

an external module selected from:

a balcony module to define a balcony; and a façade module to define a ventilated façade;

having:

an inner face configured to be coupled in a projecting manner to a dwelling module; and an outer face opposite to the inner face;

horizontal fixing means in the inner face comprising:

at least one support guide configured to house a head of a support screw having a stud embedded in a transverse lower beam;

at least one anti-overturn guide configured to house a head of an anti-overturn screw fixed to the receptacle.

35. The constructive system of claim 34, wherein the external module further comprises:

a trapezoidal support opening converging towards the support guide, configured to facilitate an entrance of the head of the support screw into the support guide.

36. The constructive system of claim 34, wherein the external module further comprises:

a trapezoidal anti-overturn opening converging towards the anti-overturn guide configured to facilitate an entrance of the head of the anti-overturn screw in the anti-overturn guide.

37. The constructive system of claim 34, wherein an element selected from the anti-overturn guide, the support guide and combinations thereof has a direction selected from parallel to the multi-purpose parts and parallel to the floor.

38. The constructive system of claim 34, wherein the external module further comprises a horizontal impost in the outer face in a site selected from upper, lower and both.

39. The constructive system of claim 34, wherein the external module further comprises an element selected from a vertical impost, a waterproofing and insulating vertical band and combinations thereof, in the outer face, in a site selected from a first side, a second side and both sides.

40. The constructive system of claim 39, wherein the external module further comprises an embedded vertical profile:

in a site selected from a first side, a second side and both sides of the external module;

to fix the waterproofing and insulating vertical band between two embedded vertical profiles of two contiguous external modules.

41. The constructive system of claim 1, further comprising at least one dwelling module and at least one roof module.

42. The constructive system of claim 41, further comprising at least one external module.

43. A constructive system comprising a stackable parallelepiped dwelling module to form a building, the dwelling module comprising:

a floor;

a roof;

a plurality of pillars between the floor and the roof, a multi-purpose part embedded in each pillar, wherein the multi-purpose part has:

a frustoconical projection at a lower end;

a first frustoconical housing at an upper end, configured to correspond with the frustoconical projection and facilitate a stacking and placement of one module on top of another by a close approximation and a tonguing and grooving ensured by an alignment of both modules at the base;

a lifting tool for a module selected from a dwelling module and a roof module, said tool having a main body comprising:

a hook:

on an upper face of the main body;

configured so that the lifting tool is suspended by lifting means;

coupling means comprising:

a first surface configured to be coupled with a leveling screw;

a second surface configured to be coupled with a frustoconical housing;

opening and closing means configured to move the coupling means in a first plane between:

a rest position, to allow an approximation and placement of the tool in the frustoconical housing and an adjustment position, in which the coupling means are retracted to allow a coupling of the tool to the leveling screw and to the frustoconical housing;

a tightening position, in which the coupling means are coupled to the leveling screw and to the frustoconical housing;

first return means, which can be formed by secondary springs to ensure that the coupling means are in the rest position, in the absence of actuation on the opening and closing means.

44. The constructive system of claim 43, wherein the opening and closing means comprise:

a mobile body movable in a direction substantially perpendicular to the first plane between a released position and an actuated position to move the coupling means between the rest position, the adjustment position and the tightening position, wherein:

the coupling means are in the rest position when the mobile body is in the released position;

the coupling means are in the adjustment position when the mobile body is in the actuated position;

the coupling means are in the tightening position when the mobile body is in the released position;

handling means to move the mobile body from the released position to the actuated position;

second return means to ensure that the mobile body is in the released position in the absence of actuation on the handling means.

45. The constructive system of claim 1, the system comprising packaging for a dwelling module wherein the packaging comprises an internal membrane:

having securing means to be connected to a plurality of internal profiles arranged in frames of first module-module connecting openings;

to cover mobile panels of a dwelling module on site.

46. The constructive system of claim 45, further comprising an external membrane to externally cover the dwelling module during storage and transport.

* * * * *